US009441890B2

(12) United States Patent
Kim et al.

(10) Patent No.: US 9,441,890 B2
(45) Date of Patent: Sep. 13, 2016

(54) HEAT EXCHANGER FIN WITH CORRUGATED PORTION AND LOUVERS

(75) Inventors: Donghwi Kim, Seoul (KR); Sangyeul Lee, Seoul (KR); Kakjoong Kim, Seoul (KR); Yongcheol Sa, Seoul (KR); Juhyok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1146 days.

(21) Appl. No.: 12/987,452

(22) Filed: Jan. 10, 2011

(65) Prior Publication Data

US 2011/0168373 A1 Jul. 14, 2011

(30) Foreign Application Priority Data

Jan. 13, 2010 (KR) ..... 10-2010-0003009

(51) Int. Cl.

| | |
|---|---|
| ***F28D 1/04*** | (2006.01) |
| ***F28F 1/32*** | (2006.01) |
| ***F28F 1/28*** | (2006.01) |

(52) U.S. Cl.

CPC ..... *F28F 1/325* (2013.01); *F28F 1/28* (2013.01); *F28F 2215/08* (2013.01); *F28F 2215/10* (2013.01)

(58) Field of Classification Search

CPC ..... F28F 1/325; F28F 1/28; F28F 2215/10; F28F 2215/08; F25F 2215/10; F25F 2215/08

USPC ..... 165/151, 152, 181, 146

See application file for complete search history.

(56) References Cited

U.S. PATENT DOCUMENTS

| | | | | |
|---|---|---|---|---|
| 5,035,052 | A * | 7/1991 | Suzuki et al. | 165/151 |
| 5,056,594 | A * | 10/1991 | Kraay | 165/151 |
| 5,360,060 | A * | 11/1994 | Tanaka et al. | 165/151 |
| 5,890,532 | A * | 4/1999 | Kim et al. | 165/151 |
| 2005/0056407 | A1* | 3/2005 | Oh et al. | 165/151 |
| 2009/0301698 | A1* | 12/2009 | Kaga et al. | 165/151 |

FOREIGN PATENT DOCUMENTS

| | | |
|---|---|---|
| CN | 1153287 | 7/1997 |
| CN | 1598434 | 3/2005 |
| JP | 62-9197 | 1/1987 |
| JP | 1-305297 | 12/1989 |
| JP | 2-71096 | 3/1990 |
| JP | 10-300377 | 11/1998 |
| JP | 10-311695 | 11/1998 |
| JP | 11-201679 | 7/1999 |
| JP | 2001-91101 A | 4/2001 |
| JP | 2002-31434 | 1/2002 |
| JP | 2006-258383 | 9/2006 |

(Continued)

OTHER PUBLICATIONS

Chinese Office Action dated Jul. 3, 2012.

(Continued)

*Primary Examiner* — Orlando Aviles Bosques

(74) *Attorney, Agent, or Firm* — KED & Associates LLP

(57) ABSTRACT

A fin for a heat exchanger is provided that may include a fin body having a first heat exchange area, and a second heat exchange area, which is disposed to be adjacent to the first heat exchange area; a fin collar that passes through the fin body and protrudes from the fin body; and a plurality of fin portions formed at or on the fin body and having different shapes from each other.

16 Claims, 4 Drawing Sheets

(56) References Cited

FOREIGN PATENT DOCUMENTS

| | | |
|---|---|---|
| JP | 2007-010280 | 1/2007 |
| KR | 10-2006-0012303 A | 2/2006 |
| WO | WO 01/75386 | 10/2001 |

OTHER PUBLICATIONS

European Search Report dated Feb. 1, 2013.
Chinese Office Action dated Mar. 11, 2013. (with translation).

* cited by examiner

HEAT EXCHANGER FIN WITH CORRUGATED PORTION AND LOUVERS

CROSS-REFERENCE TO RELATED APPLICATION(S)

The present application claims priority to Korean Patent Application No. 10-2010-0003009, filed in Korea on Jan. 13, 2010, which is incorporated herein by reference in its entirety.

BACKGROUND

1. Field

A fin for a heat exchanger and a heat exchanger having the same are disclosed herein.

2. Background

Fins for heat exchangers and heat exchangers having the same are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

The advantages, features and aspects of embodiments will become apparent from the following description with reference to the accompanying drawings, which is set forth hereinafter. The terms and words used in the description as described below are not limited to typical or dictionary definitions, but can be interpreted with proper meanings and definitions consistent with the technical ideas.

A heat exchanger is a device installed at or in, for example, an air conditioner to perform heat exchange. In such air-conditioning system, a fin-tube type heat exchanger is largely used.

The fin-tube type heat exchanger may include a fin and a tube. As the fin disposed at or in the tube in which refrigerant is circulated, louver fins and corrugated fins are widely used. The louver fin has a structure in which a part of the fin is cut and bent, and the corrugated fin has a structure in which a metal plate is bent a few times into a W-shape.

The corrugated fin has a property that little frost is formed thereon. However, in order to obtain sufficient heat transfer performance, it is necessary to increase a surface area of the corrugated fin. Further, in the case of the louver fin, it provides sufficient heat transfer performance even with a small surface area of the fin, but frost is easily generated thereon when operating the air-conditioning system in winter, thereby greatly reducing heat transfer performance.

Figure 1:
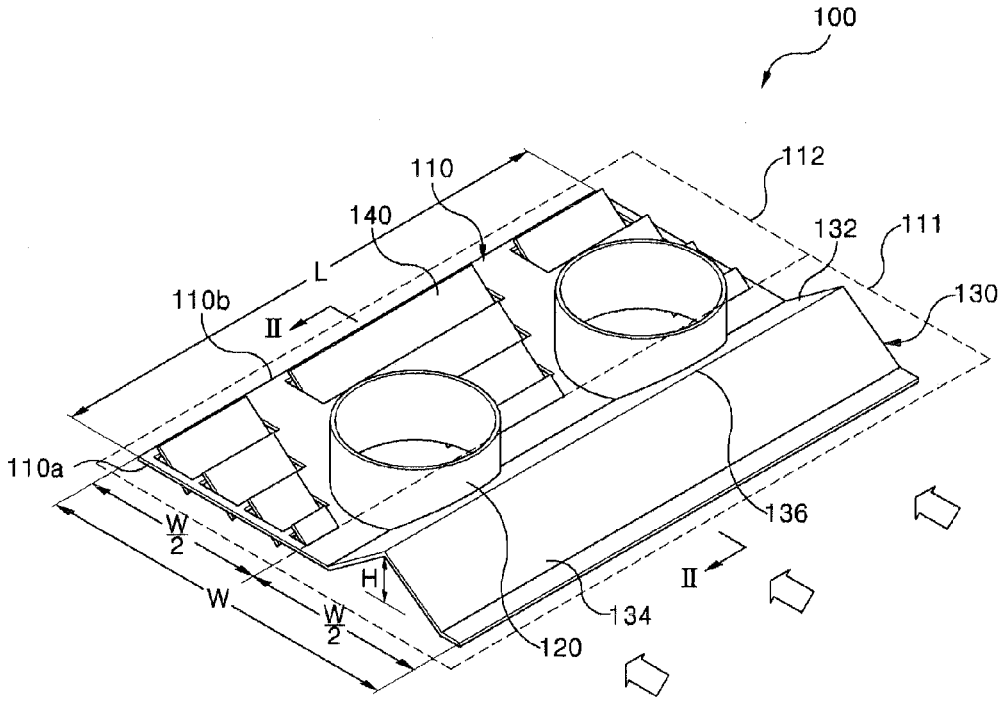
FIG. 1 is a perspective view of a fin for a heat exchanger according to an embodiment.
Figure 2:
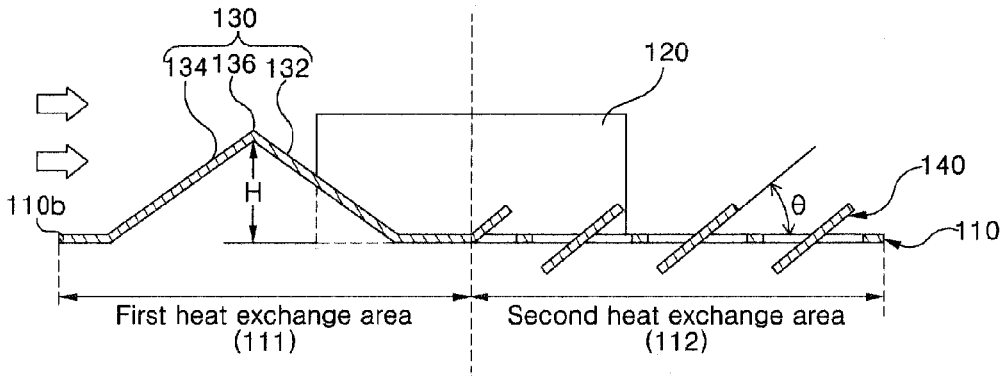
FIG. 2 is a cross-sectional view, taken along line II-II of FIG. 1.

FIG. 1 is a perspective view of a fin for a heat exchanger according to an embodiment. FIG. 2 is a cross-sectional view, taken along line II-II of FIG. 1.

Referring to FIGS. 1 and 2, a fin 100 for a heat exchanger according to this embodiment may include a fin body 110, a fin collar 120, a first fin portion 130, and a second fin portion 140. For example, the fin body 110 may include a thin metal plate. Further, the fin 110 may be formed of a metal plate having excellent thermal conductivity.

According to this embodiment, the fin body 110 may be a metal plate having a short side 110*a* and a long side 110*b*. Herein, it is defined that the short side 110*a* of the fin body 110 has a width of W, and the long side 110*b* thereof has a width or length of L. The width of the short side 110*a* may be about 10~30 mm.

The fin body 110 may be divided into a first heat exchange area 111 and a second heat exchange area 112. The first heat exchange area 111 may be defined as a region that primarily contacts air introduced from outside, and the second heat exchange area 112 may be defined as a region that secondarily contacts the air passing through the first heat exchange area 111.

According to this embodiment, the first heat exchange area 111 of the fin body 110 may have a width of W/2 and a length of L, and the second heat exchange area 112 of the fin body 110 may have a width of W/2 and a length of L. Thus, according to this embodiment, the first and second heat exchange areas 111 and 112 may divide equally the fin body 110 in a width direction. However, even though it is shown and described that the first and second heat exchange areas 111 and 112 are formed to have the same shape and surface area, the first and second heat exchange areas 111 and 112 are not limited thereto, but rather, may be formed to have different shapes and surface areas from each other.

The fin collar 120 may be formed at or on the fin body 110. According to this embodiment, the fin collar 120 may be disposed at parts of the first and second heat exchange areas 111 and 112. The fin collar 120 may cylindrically protrude from the fin body 110. A through-hole may be formed at or on the fin body 110 corresponding to the fin collar 120. The fin collar 120 may be coupled with a tube, through which refrigerant may pass.

The first fin portion 130 may be formed at or on the first heat exchange area 111. The fin portion 130 may be formed by bending at least twice the fin body 110 corresponding to the first heat exchange area 111. In this embodiment, for example, the first fin portion 130 may be bent twice. Hereinafter, a (central) bent part of the first fin portion 130 may be defined as bent portion 136.

The bent portion 136 of the first fin portion 130 may be formed to extend substantially parallel with the long side 110*b* of the fin body 110. Via the bent portion 136, a first corrugated fin portion 132 and a second corrugated fin portion 134 may be formed at or in the first heat exchange area 111 of the fin body 110.

The first corrugated fin portion 132 may be formed to be adjacent to the second heat exchange area 112, and the second corrugated fin portion 134 may connect with or to the first corrugated fin portion 132.

The first corrugated fin portion 132 may be bent in a counter-clockwise direction with respect to the fin body 110, and the second corrugated fin portion 134 may be bent in a clockwise direction with respect to the first corrugated fin portion 132. In this embodiment, for example, a bent angle between the first and second corrugate fin portions 132 and 134 may be an obtuse angle, and a predetermined height H may be formed between the bent portion 136 and the fin body 110. According to this embodiment, the height H between the bent portion 136 and the fin body 110 may be about 0.8~1.7 mm.

According to this embodiment, the first and second corrugated fin portions 132 and 134 may have the same shape and surface area. Alternatively, the first and second corrugate fin portions 132 and 134 may having different shapes and surface areas from each other in order to enhance heat transfer characteristics.

The second fin portion 140 may be formed at or in the second heat exchange area 112. The second fin portion 140 may be formed, for example, by cutting and bending a part of the fin body 110 corresponding to the second heat exchange area 112. Alternatively, the second fin portion 140 may be formed by punching or other means.

The second fin portion 140 bent from the fin body 110 may have a length that protrudes to or from lower and upper surfaces of the fin body 110. Alternatively, the second fin portion 140 may have a length that protrudes to or from only the upper surface of the fin body 110 or only the lower surface thereof.

In this embodiment, the second fin portion 140 formed at or on the second heat exchange portion 112 may be formed to extend in a direction parallel with the long side 110*b* of the fin body 110, and also at least one second fin portion 140 may be formed in a direction of the short side 110*a*. In this embodiment, 1~5 second fin portions 140 may be formed at or on the second heat exchange area 112 in the direction of the short side 110*a*, and as shown in FIG. 2, a bent angle θ between the fin body 110 and the second fin portion 140 may be approximately 10~40°.

Figure 3:
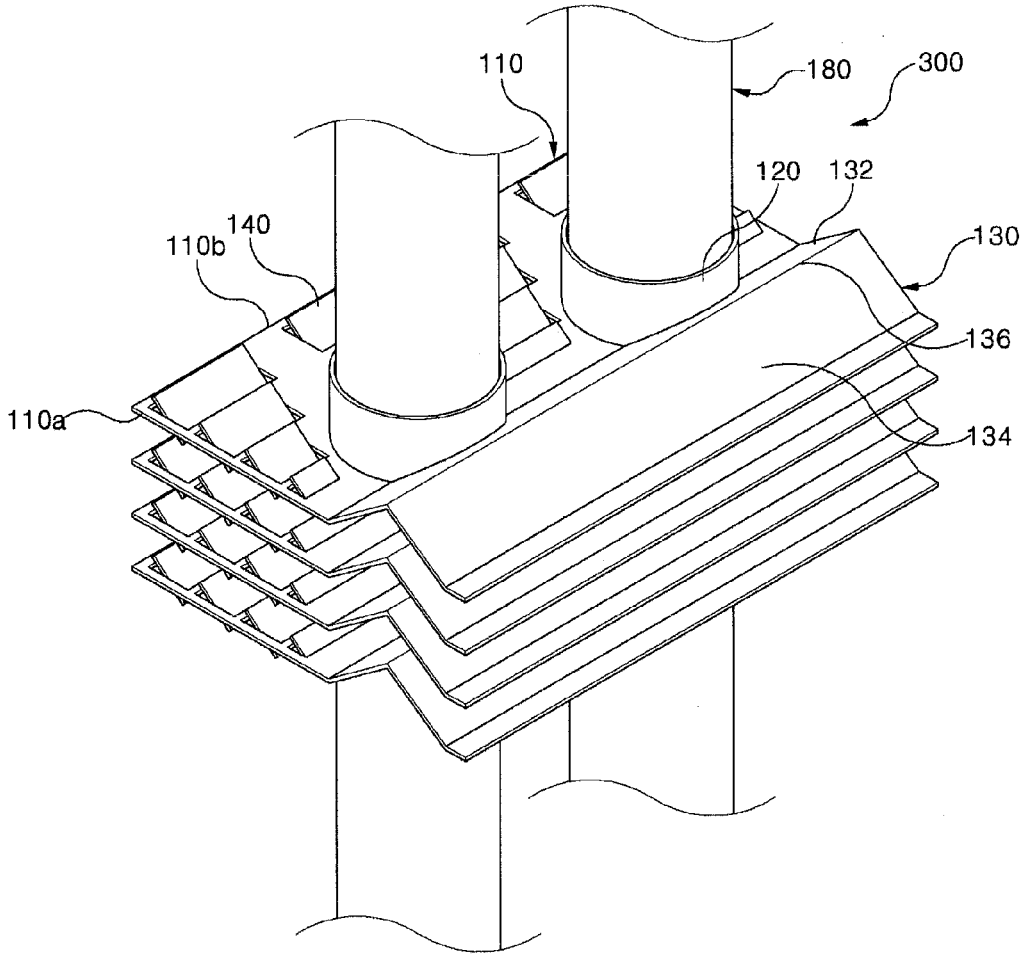
FIG. 3 is a cross-sectional view of a heat exchanger having a fin according to another embodiment.

FIG. 3 is a cross-sectional view of a heat exchanger having a fin according to an embodiment. In this embodiment, the fin used in the heat exchanger of this embodiment has the same construction as that shown in FIGS. 1 and 2. Therefore, like reference numerals have been used to indicate like elements, and repetitive disclosure omitted.

Referring to FIG. 3, a heat exchanger 300 according to this embodiment may include a fin 100 and a tube 180. The fin 100 may include a fin body 110 having first and second heat exchange areas 111 and 112 and a fin collar 120, a first fin portion 130 formed at or in the first heat exchange area 111, and a second fin portion 140 formed at or in the second heat exchange area 112.

The tube 180 may be formed in a pipe shape, through which refrigerant may flow, and the fin collar 120 of the fin 100 may be coupled to an outer surface of the tube 180. In this embodiment, a few tens to approximately a few hundred fins 100 may be coupled to the outer surface of the tube 180. A pitch between the fins 100 may be about 1~2.5 mm.

In the heat exchanger 300, the corrugated type first fin portion 130 may be disposed at or in the first heat exchange area 111, and the louver type second fin portion 140 may be formed at or in the second heat exchange area 112. Therefore, when operating the air-conditioning system in winter, the corrugated type first fin portion 130 may function to prevent or restrain generation of frost and also to prevent blockage between adjacent fins 100, and the louver type second fin portion 140 may function to improve the heat transfer performance.

According to the embodiments described herein, the corrugated type fin portion and louver type fin portion may be, respectively, formed at or on the fin(s) for the heat exchanger. More particularly, the corrugated type fin portion may be formed at or in, for example, a part of the fin that primarily contacts air, and thus, frost is frequently generated thereon, so as to prevent or restrain generation of frost, and the louver type fin portion having the excellent heat transfer performance may be formed at or on, for example, the rest or remaining part of the fin that secondarily contacts the air, so as to prevent the generation of frost and to enhance the heat transfer performance.

Figure 4:
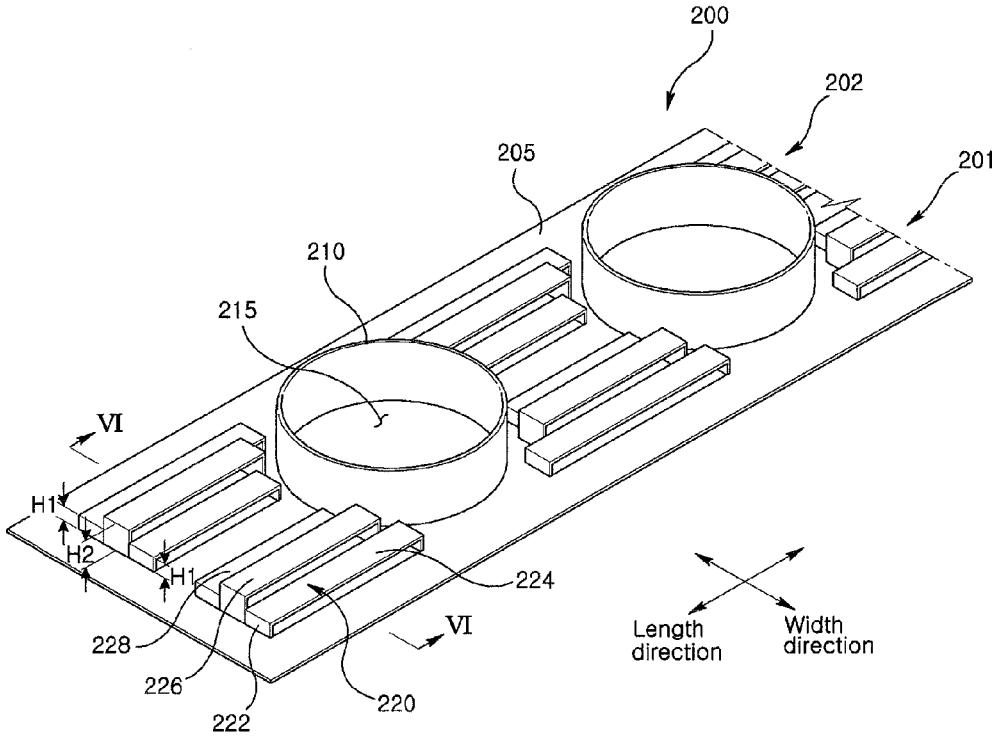
FIG. 4 is a perspective view of a fin for a heat exchanger according to another embodiment.
Figure 5:
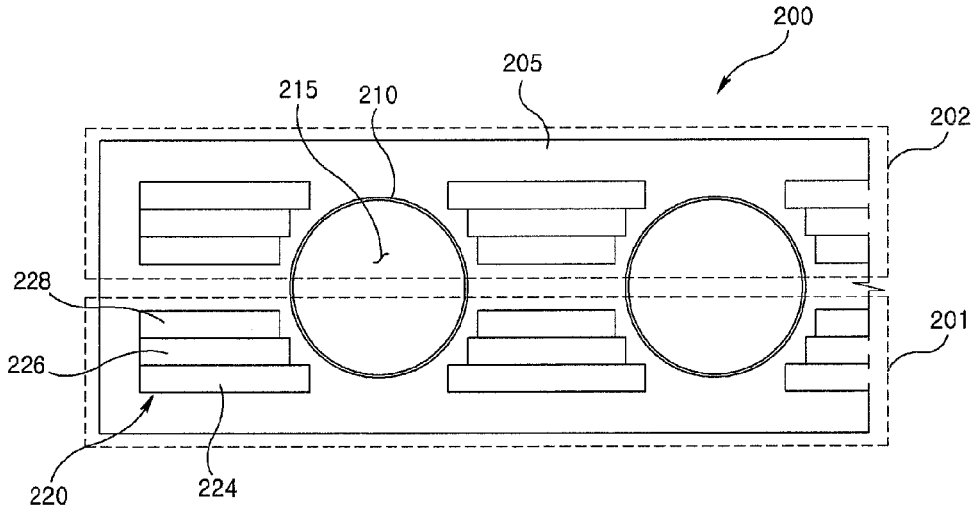
FIG. 5 is a plan view of the fin for a heat exchanger of FIG. 4.

FIG. 4 is a perspective view of a fin for a heat exchanger according to another embodiment. FIG. 5 is a plan view of the fin for the heat exchanger of FIG. 4, and FIG. 6 is a cross-sectional view, taken along line VI-VI of FIG. 4.

Figure 6:
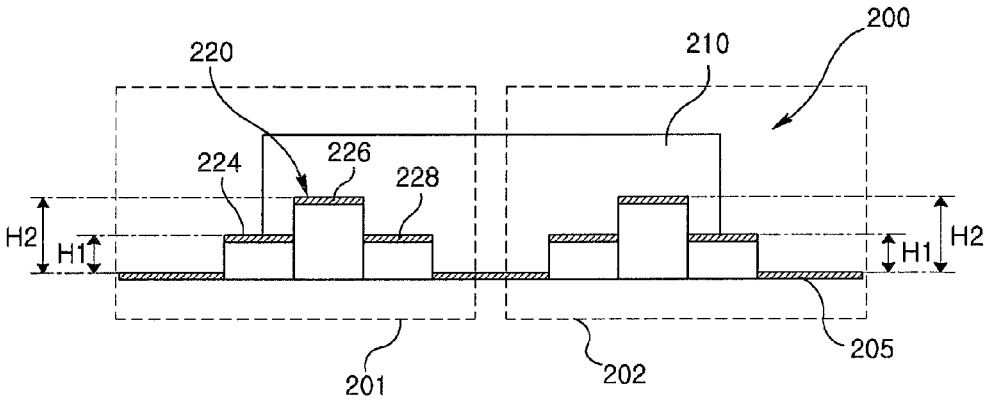
FIG. 6 is a cross-sectional view, taken along line VI-VI of FIG. 4.

Referring to FIGS. 4 to 6, a fin 200 according to this embodiment may include a fin body 205 and a fin portion 220. For example, the fin body 205 may include a thin metal plate. In this embodiment, the fin body 205 may be formed into a rectangular plate shape having a width, and a length longer than the width.

The fin body 205 may be divided, for example, into a first heat exchange area 201 and a second heat exchange area 202 with respect to a direction of the air introduced into the fin body 205. The first heat exchange area 201 may be defined as a region in which the air is primarily introduced, and the second heat exchange area 202 may be defined as a region in which the air having passed through the first heat exchange area 201 is secondarily introduced. In this embodiment, the first and second heat exchange areas 201 and 202 of the fin body 205 may have the substantially same shape and surface area.

The fin body 205 may include the fin collar 210. The fin collar 210 may be formed, for example, by burring, and may protrude from an upper surface of the fin body 205 to a desired height. A through-hole 215 may be formed at or in the fin body 205 by the fin collar 210. In this embodiment, multiple fin collars 210 may be provided, in series, at or on the fin body 205.

The plurality of fin portion(s) 220 may be provided at or in each of the first and second heat exchange areas 201 and 202. In this embodiment, each fin portion 220 disposed or in the first and second heat exchange areas 201 and 202 may be formed into a rectangular shape when viewing it in plan view.

Each opposed side of each fin portion 220 may be connected with the fin body 205 by a connecting portion 222, and each fin portion 220 may be fixed to a predetermined position by the connecting portion 222. According to this embodiment, the connecting portion 222 of each fin portion 220 may be integrally formed with the fin body 205.

A long side of each rectangular fin portion 220 may be disposed to extend parallel with or to a length of the fin body 205, and each fin portion 220 may be parallelly disposed (with respect to the other fin portion(s) 220) in a width direction of the fin body 205. The 3~8 fin portions 220 may be disposed at the fin body 205.

In this embodiment, for example, three fin portions 220 are disposed at or in the first heat exchange area 201 of the fin body 205, and also three fin portions 220 are disposed at or in the second heat exchange area 202. Hereinafter, the three fin portions 220 formed at or in the first heat exchange area 201 may be defined as a first fin portion 224, a second fin portion 226, and a third fin portion 228, respectively.

The first fin portion 224 may be disposed adjacent to a long side of the fin body 220. The first fin portion 224 may have a first height H1 from an upper surface of the fin body 220.

The second fin portion 226 may be disposed adjacent to the first fin portion 224. The second fin portion 226 may have a second height H2 from the upper surface of the fin body 220, which is higher than the first height H1.

The third fin portion 228 may be disposed adjacent to the second fin portion 226. In this embodiment, the third fin portion 228 may have the same height as the first height H1. However, embodiments are not so limited, and the third fin portion 228 may have a different height from the first height H1.

In this embodiment, the heights H1, H2, H3 of the first to third fin portions 224, 226 and 228 may be intermittently increased, and then intermittently reduced. The first to third fin portions 224, 226 and 228 may be disposed so as to extend parallel with or to the upper surface of the fin body 205.

A height difference among the first height H1 of the first fin portion 224, the second height H2 of the second fin portion 226, and the third height H3 of the third fin portion 228 may be about 0.3~1.7 mm. In a case that the height difference among the first to third heights H1, H2, and H3 is about 0.3~1.7 mm, frost is generated between the first and second fin portions 224 and 226 and between the second and third fin portions 226 and 228, and thus, the first to third fin portions 224, 226 and 228 may be connected with each other by the frost.

More particularly, in a case in which each height difference among the first to third heights H1, H2, and H3 is about 0.3~1.7 mm, frost may be generated at edges of the first to third fin portions 224, 226, and 228, when operating an air-conditioner in winter, and the frost may function as a bridge, and thus, the first to third fin portions 224, 226, and 228 may be connected with or to each other. When the air-conditioner is operated in other seasons, the first to third fin portions 224, 226 and 228 may have high heat transfer performance like in the louver fin type heat exchanger.

Meanwhile, the three fin portions may also be disposed at or in the second heat exchange area 202 adjacent to the first heat exchange area 201. The three fin portions disposed at or in the second heat exchange area 202 may have the substantially same construction and arrangement as the fin portions 220 formed at or in the first heat exchange area 201, and thus, description thereof has been omitted.

Figure 7:
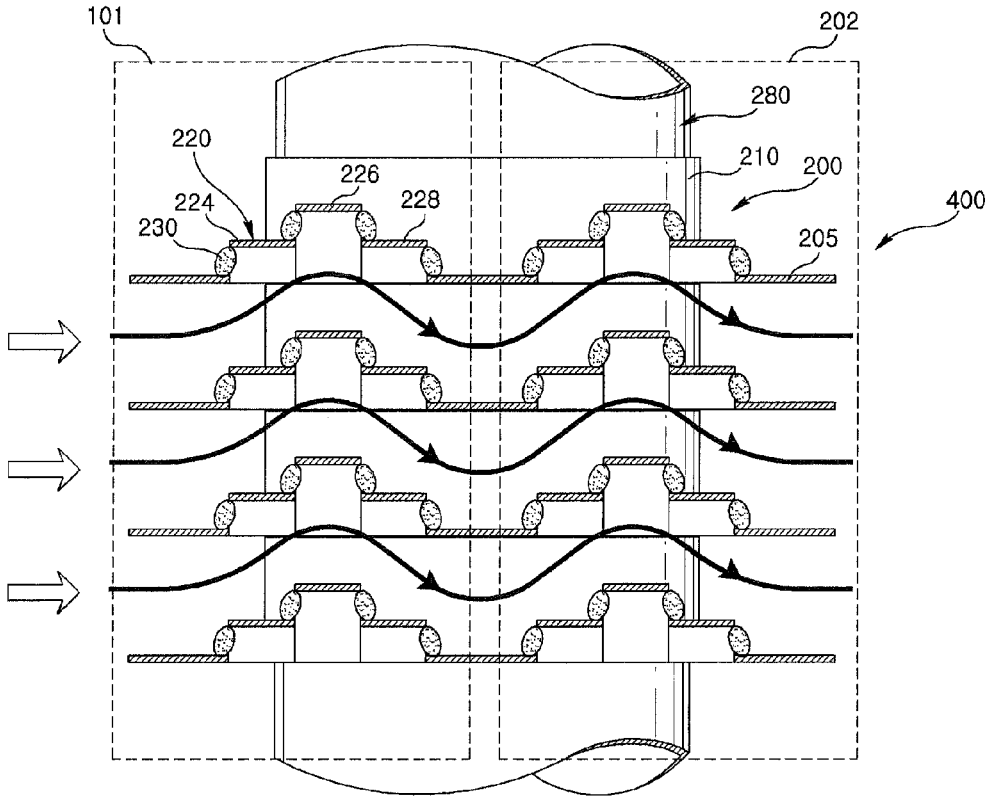
FIG. 7 is a cross-sectional view of a heat exchanger having a fin according to another embodiment.

FIG. 7 is a cross-sectional view of a heat exchanger having a fin according to another embodiment. In this embodiment, the fin used in a heat exchanger according to another embodiment has the same construction as that shown in FIGS. 4 to 6. Therefore, like reference numerals have been used to indicate like elements, and repetitive disclosure omitted.

Referring to FIG. 7, a heat exchanger 400 according to this embodiment may include a fin 200 and a tube 280. The fin 200 may include a fin body 205 having first and second heat exchange areas 201 and 202, a fin collar 210, and a fin portion 220.

The tube 280 may be formed in a pipe shape, through which refrigerant may flow, and the fin collar 210 may be coupled to an outer surface of the tube 280. In this embodiment, a few tens to approximately a few hundred fins 200 may be coupled to an outer surface of the tube 280. A pitch between the fins 200 may be about 1~2.5 mm.

In a case in which the multiple fins 200 are coupled to each tube 280, the adjacent fin portions 220 of the fin 200 may have the same pitch, and thus, a space between a fin portion 220 of the fin 200 disposed at a relatively upper side and another fin portion 220 of the fin 200 disposed at a relatively lower side may have a curved shape similar to a sine curve.

In a state in which the multiple fins 200 are coupled to the tube 280 of the heat exchanger 400, if an air-conditioner is operated in winter, frost may be formed at the fin 200 of the heat exchanger 400. In a case of the heat exchanger of the embodiment, the frost 230 may be formed between the fin portions 220 of the fin 200, and thus, edges of the adjacent fin portions 220 of the fin 200 may be connected with each other.

If the edges of the adjacent fin portions 220 having different heights are connected with each other by the frost 230, the fin portions 220 of the fin 200, which are separated by a height difference therebetween, may be connected with each other, and air flow similar to that in the corrugate type fin may be generated, thereby providing the high heat transfer characteristics or performance.

According to the embodiments disclosed herein, the fin portions of the fin may be formed to have different heights, and when the air conditioner is operated in winter, frost may connect between the fin portions having different heights of the fin, thereby providing high heat transfer performance.

Embodiments disclosed herein may provide a fin for a heat exchanger, which may suppress generation of frost when operating in an air-conditioning system in winter. Embodiments disclosed herein may further provide a heat exchanger having a fin, which may suppress generation of frost.

Embodiments disclosed herein provide a fin for a heat exchanger that may include a fin body having a first heat exchange area, and a second heat exchange area, which is disposed to be adjacent to the first heat exchange area; a fin collar that passes through the fin body and protrudes from the fin body; and a plurality of fin portions, which are formed at or on the fin body so as to have different shapes from each other.

The fin may include a first fin portion formed by bending at least once a part of the fin portion corresponding to the first heat exchange area, and a second fin portion formed by cutting and bending a part of the fin portion corresponding to the second heat exchange area.

The first fin portion may include a first corrugated fin portion bent in a counter-clockwise direction from or with respect to the fin body, and a second corrugated fin portion bent in a clockwise direction from or with respect to the first corrugated fin portion. A height of a bent portion of the first fin portion may be approximately 0.8~1.7 mm. One to five second fin portions may be disposed at or in the second heat exchange area, and a bent angle of the second fin portion(s) with respect to the fin body may be approximately 10~40°.

The fin portions may be disposed to be parallel with the fin body, and the fin portions adjacent to each other may have different heights from each other, so that edges of the fin portions may be connected with each other by frost, thereby forming a fluid path. The fin portions may include a first fin portion, which may be disposed adjacent to a long side of the fin body and may have a first height H1 from an upper surface of the fin body, a second fin portion, which may be disposed adjacent to the first fin portion and may have a second height H2 from the upper surface of the fin body, which is higher than the first height H1, and a third fin portion, which may be disposed adjacent to the second fin portion and may have a different height from the second height H2.

Embodiments disclosed herein further provide a heat exchanger that may include a tube through which refrigerant may pass; a fin body having a first heat exchange area and a second heat exchange area, which may be disposed adjacent to the first heat exchange area; a fin collar, which may pass through the fin body and protrude from the fin body; and a plurality of fin portions, which may be formed at or on the fin body so as to have different shapes from each other.

Embodiments disclosed herein may be incorporated into air conditioners which are disclosed, for example, in U.S. Pat. Nos. 7,793,551 and 7,454,921, whose entire disclosures are incorporated herein by reference.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A fin for a heat exchanger, comprising:

a planar fin body having a first heat exchange area defining a leading portion, wherein air introduced from outside the fin body first contacts said leading portion of the fin body, and a second heat exchange area disposed directly adjacent to the first heat exchange area, said second heat exchange area defining a trailing portion, wherein the air introduced from the outside of the fin subsequently contacts the trailing portion of the fin body immediately after flowing through the leading portion of the first heat exchange area;

a plurality of fin collars that pass through and protrude from said fin body, the plurality of fin collars being spaced apart from each other;

a first fin portion disposed at or on the first heat exchange area; and a second fin portion disposed at or on the second heat exchange area, wherein the first fin portion is a corrugated fin portion including a leading corrugated fin portion bent in a counter-clockwise direction from the fin body to extend at an inclined angle from a flat surface of the fin body, and a trailing corrugated fin portion bent in a clockwise direction to extend at an inclined angle from a flat surface of the fin body, and the trailing corrugated fin portion joins the leading corrugated fin portion at an apex, thereby forming a bent portion, wherein the second fin portion comprises at least one louver type fin portion that extends at an inclined angle from a flat surface of the fin body, wherein each of the at least one louver type fin portion comprises a trailing side that extends above the planar fin body, and wherein at least one of said at least one louver type fin portion comprises a leading side that extends below the planar fin body, wherein the apex of the first fin portion is higher than an end tip of the trailing side of said at least one louver type fin portion, wherein a plane divides the planar fin body into the first heat exchanger area and the second heat exchange area, and the plane passes through a center of each of the plurality of fin collars in a direction that is perpendicular to a width direction of the fin body, thereby dividing each of the fin collars in a first half and a second half, wherein the first and second heat exchange areas equally divide the fin body in the width direction of the fin body, and wherein only the first fin portion and the first half of each of the fin collars of the plurality of fin collars are disposed within the first heat exchange area, and only the second fin portion and a second half of each of the fin collars of the plurality of fin collars are disposed within the second heat exchange area.

2. The fin of claim 1, wherein a height of the apex of the first fin portion is 0.8 to 1.7 mm.

3. The fin of claim 1, wherein the at least one louver type fin portion comprises one to five louver type fin portions.

4. The fin of claim 3, wherein the angle of inclination of each second fin portion with respect to the fin body is 10° to 40°.

5. The fin of claim 1, wherein the fin body has a width of 10 to 30 mm.

6. A heat exchanger comprising the fin of claim 1.

7. The heat exchanger of claim 6, comprising a plurality of the fins of claim 1.

8. An air conditioner comprising the heat exchanger of claim 7.

9. A fin for a heat exchanger, comprising:

a planar fin body having a first heat exchange area and a second heat exchange area, wherein the first and second heat exchange areas equally divide the fin body in a width direction of the fin body, and a plane divides the fin body into the first heat exchanger area and the second heat exchange area, the first heat exchange area defining a leading portion such that air from outside the fin body first contacts said leading portion of the fin body, the second heat exchanger area is disposed directly adjacent to the first heat exchange area, said second heat exchanger area defining a trailing portion, wherein the air introduced from the outside of the fin body subsequently contacts the trailing portion of the fin body immediately after flowing through the leading portion of the first heat exchanger area;

a plurality of fin collars that pass through and protrude from the fin body, the plurality of fin collars being spaced apart from each other, and the plane passes through a center of each of the plurality of fin collars in a direction that is perpendicular to the width direction of the fin body, thereby dividing each of the fin collars in a first half and a second half;

a first fin portion located only within the first heat exchange area; and a second fin portion located only within the second heat exchange area, wherein the first fin portion is a corrugated fin portion including a leading corrugated fin portion bent in a counter-clockwise direction from the fin body to extend at an inclined angle from a flat surface of the fin body, and a trailing corrugated fin portion bent in a clockwise direction to extend at an inclined angle from a flat surface of the fin body and the trailing corrugated fin portion meets the leading corrugated fin portion at an apex, wherein the second fin portion comprises at least one louver type fin portion that extends at an inclined angle from a flat surface of the fin body, wherein each of the at least one louver type fin portion comprises a trailing side that extends above the planar fin body, and wherein at least one of said at least one louver type fin portion comprises a leading side that extends below the planar fin body, wherein the apex of the first fin portion is higher than an end tip of the trailing side of said at least one louver type fin portion.

10. The fin of claim 9, wherein a height of the apex of the first fin portion is 0.8 to 1.7 mm.

11. The fin of claim 9, wherein the at least one louver type fin portion comprises one to five louver type fin portions.

12. The fin of claim 11, wherein the angle of inclination of each second fin portion with respect to the fin body is 10° to 40°.

13. The fin of claim 9, wherein the fin body has a width of 10 to 30 mm.

14. A heat exchanger comprising the fin of claim 9.

15. The heat exchanger of claim 14, comprising a plurality of the fins of claim 9.

16. An air conditioner comprising the heat exchanger of claim 15.

* * * * *